US009198250B2

(12) United States Patent
Malyna et al.

(10) Patent No.: US 9,198,250 B2
(45) Date of Patent: Nov. 24, 2015

(54) LED LIGHT SOURCE

(71) Applicant: KONINKLIJKE PHILIPS N.V., Eindhoven (NL)

(72) Inventors: Dmytro Viktorovych Malyna, Eindhoven (NL); Patrick Alouisius De Bruycker, Nuenen (NL); Harald Josef Gunther Radermacher, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/375,245

(22) PCT Filed: Jan. 15, 2013

(86) PCT No.: PCT/IB2013/050358
§ 371 (c)(1),
(2) Date: Jul. 29, 2014

(87) PCT Pub. No.: WO2013/114234
PCT Pub. Date: Aug. 8, 2013

(65) Prior Publication Data

US 2015/0022108 A1 Jan. 22, 2015

Related U.S. Application Data

(60) Provisional application No. 61/593,906, filed on Feb. 2, 2012.

(51) Int. Cl.
*H05B 37/02* (2006.01)
*H05B 33/08* (2006.01)

(52) U.S. Cl.
CPC ..... *H05B 33/0848* (2013.01); *H05B 33/0809* (2013.01); *H05B 33/0815* (2013.01)

(58) Field of Classification Search
USPC ..... 315/200 R, 219, 224, 291, 307, 308
See application file for complete search history.

(56) References Cited

U.S. PATENT DOCUMENTS

| | | | | |
|---|---|---|---|---|
| 8,508,147 | B2 * | 8/2013 | Shen | 315/287 |
| 8,829,819 | B1 * | 9/2014 | Angeles et al. | 315/308 |
| 8,847,517 | B2 * | 9/2014 | Sutardja et al. | 315/307 |
| 2011/0254525 | A1 | 10/2011 | Gaknoki | |
| 2011/0291583 | A1 | 12/2011 | Shen | |
| 2013/0181624 | A1 * | 7/2013 | Kang | 315/200 R |

FOREIGN PATENT DOCUMENTS

| | | | |
|---|---|---|---|
| WO | WO2010137002 | A1 | 12/2010 |
| WO | WO2011001327 | A1 | 1/2011 |

* cited by examiner

*Primary Examiner* — Tung X Le
(74) *Attorney, Agent, or Firm* — Yuliya Mathis

(57) ABSTRACT

The invention relates to a dimmable LED light source comprising:—a rectifier having rectifier input terminals for connection to respective output terminals of a phase cut dimmer of the trailing edge type, input terminals of the phase cut dimmer being connected to the mains supply, and having rectifier output terminals,—a first bleeder circuit connecting the rectifier output terminals, —a series arrangement comprising a unidirectional element and a capacitive means connecting the rectifier output terminals, —a converter circuit, having input terminals coupled to respective sides of the capacitive means and output terminals coupled to a LED load, for generating a current through the LED load, in dependence on a dim signal, out of a voltage present across the capacitive means, —a dim circuit for generating a dim signal as a function of the adjusted phase angle of the phase cut dimmer and for supplying the dim signal to a dim input of the converter circuit, the dim circuit comprising: —gradient detection circuitry for determining the gradient of the voltage across the capacitive means and for determining as the adjusted phase angle the first value of the phase angle for which the gradient is negative, when the phase angle is less than 90 degrees, —signal generating circuitry for generating a sinusoidal signal that represents the mains supply voltage, —circuitry for activating the first bleeder when the phase angle is 90 degrees and for switching off the first bleeder when the adjusted phase angle has been determined, in case the adjusted phase angle is higher than 90 degrees, —deviation detection circuitry for detecting the deviation of the voltage across the rectifier output terminals from the sinusoidal signal, for comparing the deviation voltage with a reference voltage and for determining as the adjusted phase angle the value of the phase angle for which the deviation voltage is higher than or equal to the reference voltage, when the phase angle is between 90 and 180 degrees.

8 Claims, 3 Drawing Sheets

LED LIGHT SOURCE

CROSS-REFERENCE TO PRIOR APPLICATIONS

This application is a U.S. national stage application under 35 U.S.C. §371 of International Application No. PCT/IB2013/050358, filed on Jan. 15, 2013, which claims priority benefit under 35 U.S.C. §119(e) of U.S. Provisional Application No. 61/593,906 filed on Feb. 2, 2012, the contents of which are herein incorporated by reference.

FIELD OF THE INVENTION

The invention relates to a LED light source that is dimmable by means of a trailing edge phase cut dimmer. The invention also relates to a method of dimming a LED light source.

BACKGROUND OF THE INVENTION

A LED light source is known from WO2010137002A1, and is shown together with a phase cut dimmer of the trailing edge type in FIG. 1.

In FIG. 1, K1 and K2 are input terminals for connection to a supply voltage source supplying an AC supply voltage such as the mains supply. Bi-directional switch S1, snubber capacitor C1 and timing circuitry TC are comprised in a phase cut dimmer of the trailing edge type. Terminals K3 and K4 are input terminals of a rectifier formed by diodes D5-D8. Terminal K4 is connected to input terminal K2. Input terminal K1 is connected to terminal K3 via bidirectional switch S1.

A first output terminal and a second output terminal of the rectifier are connected by a first series arrangement of a resistor R-WB and switch S2 and also by a second series arrangement of a resistor R-SB and switch S3. A control electrode of switch S2 is coupled to an output of comparator COMP1 and a control electrode of switch S3 is coupled to an output terminal of comparator COMP2. A first input terminal of comparator COMP1 and a first input terminal of comparator COMP2 are both connected to the first output terminal of the rectifier. At a second input terminal of comparator COMP1 a reference voltage Vref1 is present and at a second input terminal of comparator COMP2 a reference voltage Vref2 is present. Resistor R-WB, switch S2 and comparator COMP1 together form a first bleeder and resistor R-SB, switch S3 and comparator COMP2 together form a second bleeder.

The first and second output terminals of the rectifier are also connected by means of a series arrangement comprising a diode D9 and a capacitor C2.

The function of the first bleeder is to charge the snubber capacitor C1, when the bidirectional switch S1 has become non-conductive and the diode D9 is blocking. The function of the second bleeder is to charge the power supply of the dimmer (not shown) and reset the timing circuitry comprised in the dimmer.

Respective input terminals of converter CONV are connected to respective sides of capacitor C2. Output terminals of the converter CONV are connected to a LED load LED. Converter CONV is a converter for generating a current through the LED load LED out of a voltage present across capacitor C2.

The first and second output terminals of the rectifier are also connected by a series arrangement of resistors R2 and R3. Resistor R3 is shunted by capacitor C3. Resistors R2 and R3 together with capacitor C3 form a low pass filter for generating a dim signal. The input terminals of the low pass filter are formed by the first and second output terminals of the rectifier and, during operation, the dim signal is present across the capacitor C3. A common terminal of resistor R2 and capacitor C3 is connected to a dim input terminal of converter CONV, so that the dim signal is supplied to this dim input terminal of the converter.

When the mains supply is connected to input terminals K1 and K2, the sinusoidal supply voltage supplied by the mains supply is phase cut by the phase cut dimmer and the phase cut sinusoidal supply voltage is rectified by means of the rectifier.

Since the phase cut dimmer is of the trailing edge kind, during each half period of the AC supply voltage the dimmer switch is first maintained conductive and then switched off at the adjusted phase angle of the phase cut dimmer. The dimmer switch is subsequently maintained in a non-conductive state until the end of the half period.

The rectified phase cut mains supply voltage (when its momentary magnitude is higher than the voltage across the capacitor C2) causes a charging current to flow via diode D9 to capacitor C2. The voltage across the capacitor is used to supply the converter CONV and thus also to supply the LED load LED connected to its output terminals. The converter generates a current through the LED loads.

To ensure a proper operation of the phase cut dimmer, in spite of the fact that the LED light source consumes less current than an incandescent lamp for which the phase cut dimmer was actually designed, the known LED light source is further equipped with the first bleeder and the second bleeder connected between the first and second output terminals of the rectifier. The first bleeder carries a comparatively small current and is switched on when the voltage between the first and second rectifier output terminals is below a first predetermined value (e.g. 200V). The second bleeder carries a higher current and is only switched on when the voltage between the first and second rectifier output terminals drops below a second predetermined value (e.g. 50 V), much lower than the first predetermined value.

The magnitude of the current through the LED load depends on the dim signal that is supplied to the dim input of the converter and thus is a function of the shape of the voltage present between the output terminals of the rectifier and hence also a function of the adjusted phase angle of the phase cut dimmer.

In case the phase cut dimmer were used to dim an incandescent lamp, the dim signal present at the output terminals of the low pass filter would have a different value for each value of the adjusted phase angle of the phase angle dimmer. This is because the voltage between the first and second output terminals of the rectifier would have a steep edge at the adjusted phase angle of the phase angle dimmer (or in other words at the moment the dimmer switch S1 is rendered non-conductive). In the case of the LED light source described hereinabove, however, some undesired effects occur when the phase cut dimmer is of the trailing edge type and the adjusted phase angle is between 90 degrees and the value of the phase angle for which the voltage between the first and second rectifier output terminals equals the first predetermined value (in other words the voltage at which the first bleeder is activated). In this case, the capacitor C2 supplying the converter is charged to a voltage that equals the amplitude of the mains supply voltage, when the phase angle is 90 degrees. When the phase angle increases further, no current flows to the capacitor, since its voltage is higher than the momentary amplitude of the voltage present between the first output terminal and the second output terminal of the rectifier. Flow of current in the opposite direction is impeded by the diode. Since the impedance of the snubber capacitor C1 comprised in the dimmer is much lower than the input impedance of the LED light source, the voltage between the first and second output terminals of the rectifier follows the shape of the mains voltage until the first bleeder is activated, irrespective of whether the dimmer switch is conductive or not. As a consequence, the dim signal present between the output terminals of the low pass filter is the same for all adjusted phase angle values that lie between 90 degrees and the phase angle at which the first bleeder is activated. This causes a discontinuity in the dimming curve, i.e. the relation between adjusted phase angle and light output of the LED load LED.

Furthermore, when the dimmer switch is made non-conductive after the first bleeder has been activated, the bleeder current causes a slight distortion of the dim signal, resulting in non-linearity of the relation between the adjusted phase angle and the light output of the LED load. Since the phase angle is adjusted by a user, it is desirable that the relation between adjusted phase angle of the phase cut dimmer and the light output is free of discontinuities and non-linearities.

In FIG. 2, several voltages in the circuitry shown in FIG. 1 are shown as a function of time. In FIG. 2, switch S1 is made non-conductive 6 msec. after the zero crossing of the mains voltage and the first bleeder is activated after 8 msec. Curve V1 is the mains supply voltage, curve V2 is the voltage across the capacitor C2, V3 is the voltage between the first and second output terminals of the rectifier and curve V4 is the shape of the voltage across the output terminals of the rectifier in case diode D9, capacitor C2, converter CONV and LED load LED were jointly replaced by an incandescent lamp. In curve V4 there is a steep trailing edge when the switch S1 in the phase cut dimmer is made non-conductive. This trailing edge is far steeper than curve V3, because the incandescent lamp draws more current than the LED light source, and hence capacitor C1 is charged quickly.

It can be seen that curve V3 has exactly the same shape as the mains voltage between 5 msec (a phase angle of 90 degrees) and 8 msec, whereas after 8 msec curve V3 is dropping somewhat steeper than the mains supply voltage, but not as steep as curve V4, because the time constant of the RC circuit R_WB*C1 is larger than it would be if the load were an incandescent lamp.

SUMMARY OF THE INVENTION

It is an object of the invention to provide a LED light source that is dimmable by means of a phase cut dimmer of the trailing edge kind, while discontinuity and non-linearity in the relation between the dim signal and the light output are avoided. According to a first aspect of the invention, a dimmable LED light source is provided comprising:

a rectifier having rectifier input terminals for connection to respective output terminals of a phase cut dimmer of the trailing edge type and having rectifier output terminals, said phase cut dimmer having input terminals for connection to the mains supply, a first bleeder circuit connecting the rectifier output terminals, a series arrangement comprising a unidirectional element and a capacitive means connecting the rectifier output terminals, a converter circuit, having input terminals coupled to respective sides of the capacitive means and output terminals coupled to a LED load, for generating a current through the LED load, in dependence on a dim signal, out of a voltage present across the capacitive means, a dim circuit for generating a dim signal as a function of the adjusted phase angle of the phase cut dimmer and for supplying the dim signal to a dim input of the converter circuit, the dim circuit comprising gradient detection circuitry for determining the gradient of the voltage across the capacitive means and for determining as the adjusted phase angle the first value of the phase angle for which the gradient is negative, when the phase angle is smaller than or equal to 90 degrees during the first half period of the voltage between the rectifier output terminals, signal generating circuitry for generating a sinusoidal signal that represents the mains supply voltage, circuitry for activating the first bleeder when the phase angle is 90 degrees and for switching off the first bleeder when the adjusted phase angle has been determined, deviation detection circuitry for detecting the deviation of the voltage across the rectifier output terminals from the sinusoidal signal, for comparing the deviation voltage with a reference voltage and for determining as the adjusted phase angle the first value of the phase angle for which the deviation voltage is higher than or equal to the reference voltage, when the phase angle is between 90 and 180 degrees during the second half period of the voltage across the rectifier output terminals.

It has been found that determining the adjusted phase angle of the phase cut dimmer in a dimmable LED light source according to the invention in this way makes it possible to generate a dim signal that enables good continuity and good linearity of the dimming behavior.

According to a further aspect of the invention, a method is provided for dimming a LED light source, comprising the steps of providing a phase cut dimmer and using the phase cut dimmer to generate a phase cut sinusoidal supply voltage out of a sinusoidal supply voltage, rectifying the phase cut sinusoidal supply voltage using a rectifier having a first rectifier output terminal and a second rectifier output terminal, supplying the rectified phase cut sinusoidal supply voltage to a series arrangement of a unidirectional element and capacitive means, providing a converter circuit having a LED load coupled to its output terminals and using the converter for generating a current through said LED load out of a voltage across the capacitive means, determining the gradient of the voltage across the capacitive means and determining as the adjusted phase angle the first value of the phase angle for which the gradient is negative, when the phase angle is between 0 and 90 degrees during the first half period of the rectified sinusoidal supply voltage, generating a sinusoidal signal that represents the mains supply voltage, activating a bleeder when the phase angle is 90 degrees and switching off the bleeder after the adjusted phase angle has been determined, detecting a deviation of the rectified phase cut sinusoidal supply voltage from the sinusoidal signal, when the phase angle is between 90 and 180 degrees during the second half period of the rectified sinusoidal supply voltage, comparing the deviation voltage with a reference voltage, determining as the adjusted phase angle the first value of the phase angle for which the deviation voltage is higher than or equal to the reference voltage, generating the dim signal as a function of the adjusted phase angle, and controlling the magnitude of the current through the LED load as a function of the dim signal.

Also the method according to the invention enables dimming of the LED light source with good linearity and good continuity.

Further elaborations of the invention are mentioned in the dependent claims.

BRIEF DESCRIPTION OF THE DRAWINGS

An embodiment of a prior art LED light source and an embodiment of a LED light source according to the invention will be further described making use of a drawing.

In the drawing.

DESCRIPTION OF EMBODIMENTS

Figure 3:
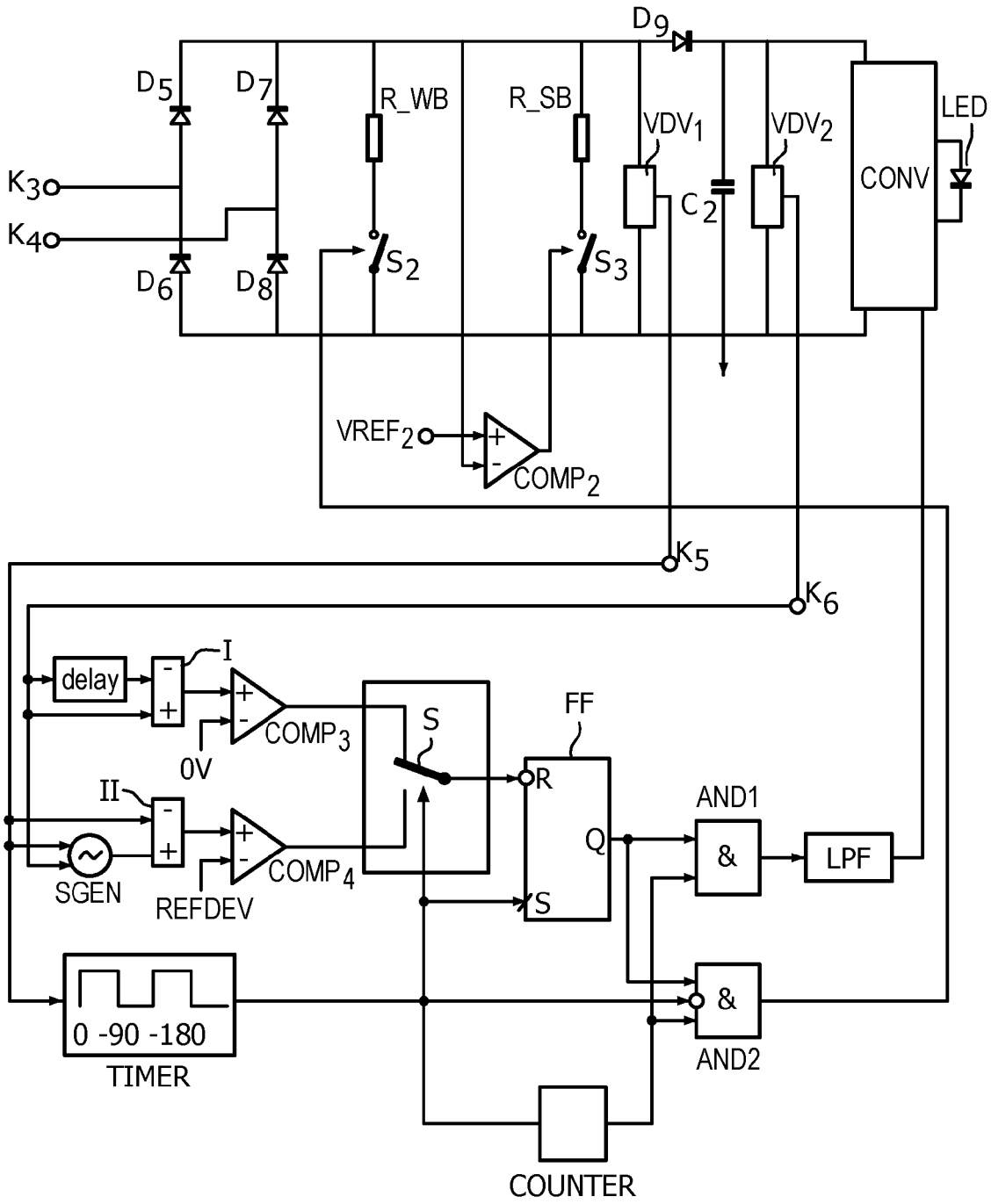
FIG. 3 shows a schematic representation of an embodiment of a dimmable LED light source according to the invention.

The LED light source in FIG. 3 comprises input terminals K3 and K4, a diode bridge comprising diodes D5-D8, a first bleeder comprising a resistor R-WB and a switch S2, a second bleeder comprising resistor R-SB and switch S3, diode D9, capacitor C2, converter CONV and LED load LED. These components and circuit parts bear the same reference signs and are also interconnected in the same way as in the LED light source shown in FIG. 1. The low pass filter comprised in the LED light source shown in FIG. 1 is dispensed with in the LED light source shown in FIG. 3.

Figure 1:
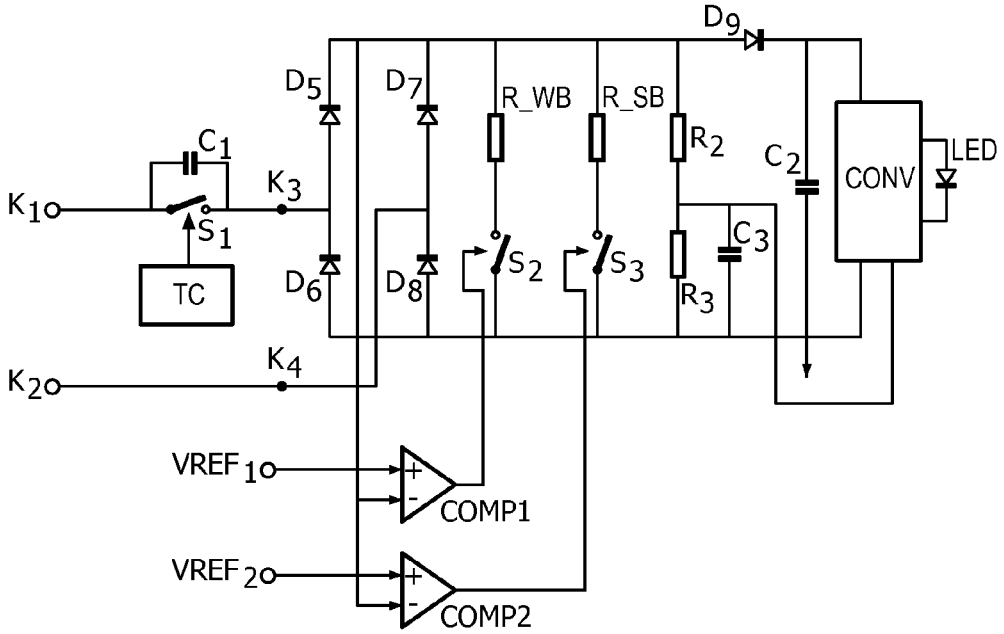
FIG. 1 (Prior Art)
FIG. 1 shows a schematic representation of an embodiment of a dimmable LED light source according to the prior art together with a phase cut dimmer of the trailing edge type.
Figure 2:
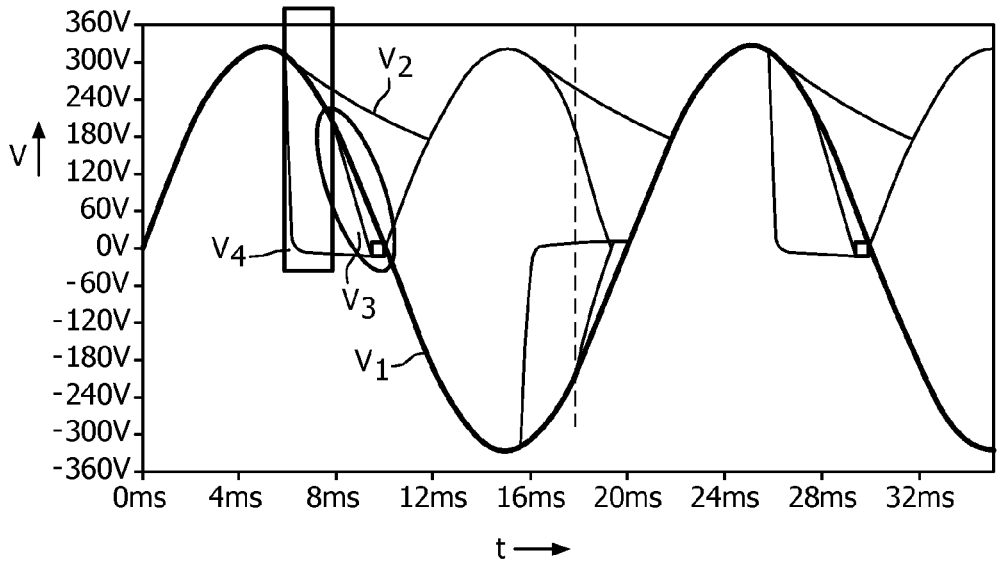
FIG. 2 (Prior Art)
FIG. 2 shows the shape of several voltages at different terminals in the LED light source shown in FIG. 1 during dimmed operation.

Although not shown in FIG. 3, the input of the LED light source is coupled to the output of a phase cut dimmer of the trailing edge type, like the one shown in FIG. 1. The control of the second bleeder is identical to the control of the second bleeder in the LED light source shown in FIG. 1. The control of the first bleeder, however, and the operation of the dim circuit are entirely different.

In the LED light source shown in FIG. 3, a detection circuit is comprised for determining the adjusted phase angle of the phase cut dimmer. In the first half of a period of the rectified phase cut supply voltage present between the rectifier output terminals (in other words in the phase angle range from 0 degrees to 90 degrees), the gradient of the voltage across capacitor C2 is measured. In case the dimmer switch S1 is made non-conductive in this time lapse, the gradient of the voltage across capacitor C2 changes from positive to negative. This change in the gradient allows detection of the adjusted phase angle of the phase cut dimmer. In case a phase angle of 90 degrees is reached without a change in the gradient of the voltage across capacitor C2 from positive to negative, the first bleeder is activated at this phase angle.

In the second half of a period of the rectified phase cut supply voltage, (in other words in the phase angle range from 90 degrees to 180 degrees), detection of the adjusted phase angle of the phase cut dimmer is effected by comparing this rectified phase cut supply voltage with a reference voltage representing the supply voltage. The deviation (i.e. the difference between these two voltages) is in turn compared with a reference representing a predetermined deviation.

The moment at which the measured deviation becomes larger than the reference, is the moment that corresponds to the adjusted phase angle of the phase cut dimmer. After the adjusted phase angle has been determined, the first bleeder is switched off.

Circuitry for generating the reference voltage representing the supply voltage is comprised in the detection circuitry. This circuitry is also called an estimator. The frequency and phase of the reference voltage is derived from the rectified phase cut supply voltage. Since the shape of the rectified phase cut mains supply voltage is identical to that of the mains supply voltage, before the dimmer switch becomes non-conductive, the zero crossings of the mains supply can easily be derived from the rectified phase cut supply voltage that is present between the first and second output terminals of the rectifier. This also allows timing of a phase angle of 0 degrees, 90 degrees and 180 degrees. The highest amplitude of the reference voltage is derived from the voltage across capacitor C2 when the phase angle equals 90 degrees.

In FIG. 3, the detection circuit is represented in a schematic way. VDV1 represents a voltage divider connected between the output terminals of the rectifier. During operation, a voltage that is proportional to the rectified phase cut supply voltage is present at output terminal K5 of voltage divider VDV1.

VDV2 represents a voltage divider shunting capacitor C2. During operation, a voltage that is proportional to the voltage across capacitor C2 is present at an output terminal K6 of voltage divider VDV2.

The detection circuit comprises a timer. An input terminal of this timer is connected to terminal K5. The timer times the phase angle in degrees and synchronizes zero degrees and 180 degrees with the voltage at terminal K5.

The time lapse between a phase angle of zero degrees and a phase angle of 90 degrees is considered first. Output terminal K6 is connected to a first input terminal of circuit part I via a delay circuit and also directly to a second input terminal of circuit part I. Circuit part I subtracts the delayed voltage from the non-delayed voltage. A voltage that equals the difference between the non-delayed voltage and the delayed voltage at output terminal K6 is present at the output terminal of circuit part I and therefore also at a connected first input terminal of a comparator COMP3. At another input terminal of comparator COMP3, a reference voltage equal to zero Volt is present. As long as the difference between the non-delayed voltage and the delayed voltage at terminal K6 is positive (in other words as long as the voltage across capacitor C2 is increasing), the output of the comparator COMP3 is high. During the time lapse between a phase angle of zero degrees and a phase angle of 90 degrees, a switch S connects the output terminal of comparator COMP3 with input terminal R of a circuit part FF. Circuit part FF is a bistable multivibrator or flip flop. As a consequence, the voltage present at the input terminal R is also high, which causes the output terminal Q of the circuit part FF to be high as well. This high signal at the output terminal Q of circuit part FF indicates that the dimmer switch S1 is conductive.

In case the dimmer switch S1 is rendered non-conductive before the phase angle equals 90 degrees, the voltage across capacitor C2 starts decreasing. As a consequence, the voltage at the output terminal of circuit part I will become negative and the voltage at the output terminal of comparator COMP3 and the input terminal R of circuit part FF will become low so that the output terminal Q of the circuit part FF will become low as well, indicating that the dimmer switch S1 is non-conductive.

When the phase angle is 90 degrees (or in other words at the end of the first half period of the rectified phase cut supply voltage), the timer produces an output signal that makes switch S disconnect the output terminal of comparator COMP3 from the input terminal R of circuit part FF and connect an output terminal of comparator COMP4 with the input terminal R of the circuit part FF.

The same output signal is supplied to input terminal S of circuit part FF to set the circuit part FF, when the timer has timed 180 degrees.

Output terminal K6 and output terminal K5 are connected to input terminals of circuit part SGEN. Circuit part SGEN is a signal generator for generating a signal that represents the mains supply voltage. As explained hereinabove, the signal generator derives the amplitude of the mains supply from the maximum voltage across capacitor C2, when the adjusted phase angle is 90 degrees and synchronizes with the voltage at terminal K5 (that is proportional to the rectified phase cut supply voltage between the first and second output terminals of the rectifier). The signal representing the mains supply voltage is present at an output terminal of circuit part SGEN and at a first input terminal of circuit part II that is connected to the output terminal of circuit part SGEN. A second input terminal of circuit part II is connected to output terminal K5. Circuit part II subtracts the voltage at its second input terminal from the voltage at its first input terminal. The outcome of this subtraction is the deviation between the mains supply voltage and the voltage between the first and second output terminals of the rectifier. This deviation is present at an output terminal of circuit part II and also at a connected first input terminal of comparator COMP4. A second input terminal of the comparator COMP4 is connected to a reference voltage source supplying a reference voltage REFDEV.

In case the dimmer switch S1 was already made non-conductive at a phase angle lower than 90 degrees, the deviation is higher than the reference signal REFDEV, so that the output of comparator COMP4 is low and also the input R and the output Q of circuit part FF are low.

In case the dimmer switch S1 is still conductive at a phase angle of 90 degrees, the signal produced by the timer output activates the first bleeder. In this case the voltage at the output terminal of circuit part II is zero Volt and the output of comparator COMP4 and the output of circuit part FF are both high, indicating that the dimmer switch S1 is still conductive.

In case the dimmer switch is made non-conductive at a phase angle between 90 degrees and 180 degrees, the voltage between the first and second output terminals of the rectifier starts to deviate from the mains supply voltage. As soon as the deviation is larger than the reference voltage DEVREF, the voltage at the output terminal of comparator COMP4 becomes low and therefore also the voltage at the output terminal Q of circuit part FF becomes low, indicating that the dimmer switch has become non-conductive. The output terminal of circuit part FF is connected to an input terminal of and-gate AND1, and an output terminal of and-gate AND1 is connected to an input terminal of low pass filter LPF. An output terminal of the low pass filter LPF is connected to a dim input terminal of the converter CONV. It is assumed for a moment that the and-gate AND1 continuously connects the output terminal Q of circuit part FF to the input terminal of the low pas filter LPF. In that case the voltage present at the output terminal of the low pass filter is an average value of the voltage present at the output terminal Q of circuit part FF. It is this voltage at the output terminal of the low pass filter LPF that is used as a dim signal to control the current through the LED load LED and thereby the light output of the LED light source.

When the timer times 180 degrees, the circuit part FF is reset via input terminal S and also the switch S once more connects the output terminal of comparator COMP3 to the input terminal R of circuit part FF and disconnects the input terminal R from the output terminal of comparator COMP4.

The detection circuit further comprises a counter for counting the number of periods of the rectified phase cut supply voltage or in other words the number of times the timer times the phase angle from zero degrees to 180 degrees. Of course it is not necessary to determine the adjusted phase angle and the corresponding dim signal for each period of the rectified phase cut supply voltage. It is also possible to do so for instance only once in every ten or twenty periods, for instance to reduce power dissipation in the first bleeder. To this end the counter is connected to the output terminal of the timer. The counter counts the number of periods of the rectified phase cut supply voltage and makes the voltage at its output terminal only high for instance during one of 10 or 20 periods.

During this one period the adjusted phase angle and the dim signal are determined. During the other periods the voltage at the output terminal of the counter is low, so that the output voltage of and-gates AND1 and AND2 is low, so that no signal is supplied to the low pass filter LPF and the first bleeder is not activated.

It is noteworthy that in the periods of the rectified phase cut supply voltage, wherein the first bleeder is activated, the power dissipation is comparatively high because at 90 degrees the voltage across the output terminals of the rectifier is comparatively high. However, this is compensated in case the bleeder is only activated in a small fraction of the periods of the rectified phase cut supply voltage.

Figure 4:
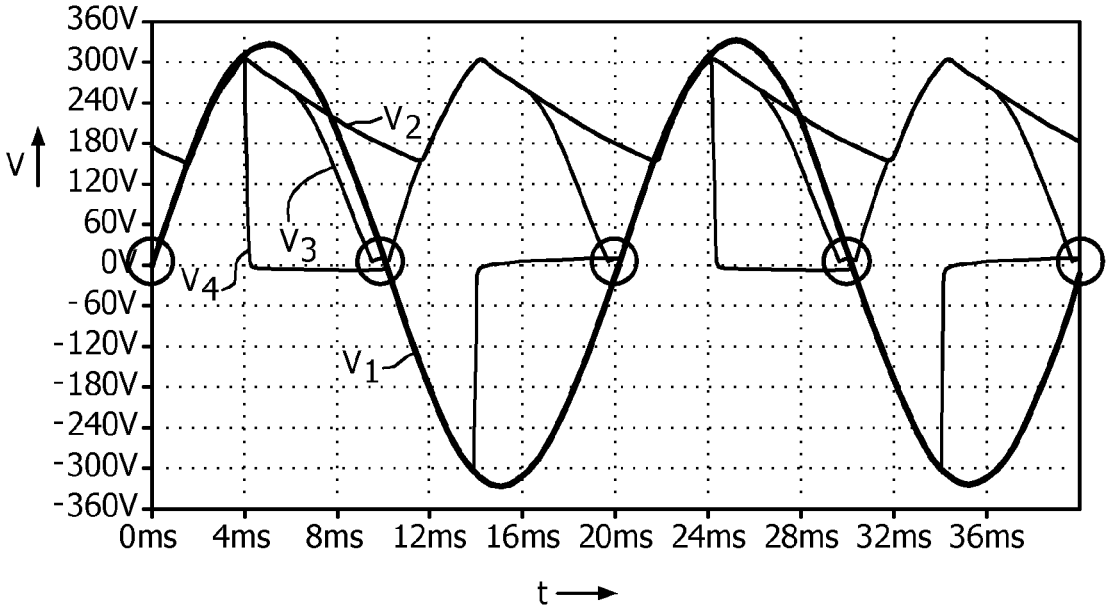
FIG. 4 shows the shape of several voltages at different terminals in the LED light source shown in FIG. 3 during dimmed operation in case the adjusted phase angle of the dimmer is lower than 90 degrees.
Figure 5:
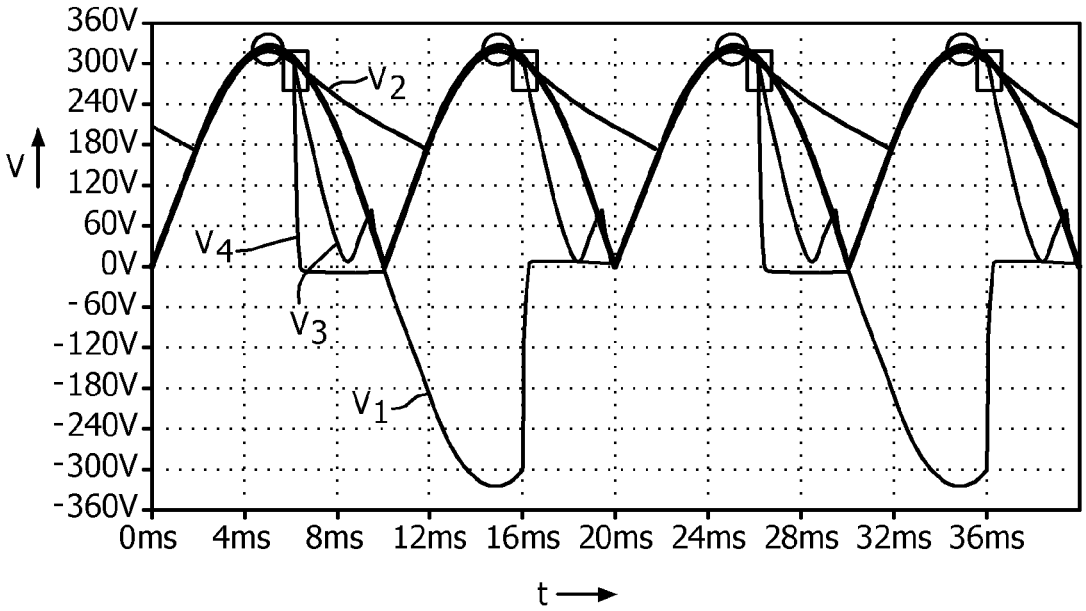
FIG. 5 shows the shape of several voltages at different terminals in the LED light source shown in FIG. 3 during dimmed operation in case the adjusted phase angle of the dimmer is between 90 and 180 degrees.

FIG. 4 shows the shape of voltages as a function of time in the LED light source shown in FIG. 3, for an adjusted phase angle smaller than 90 degrees. FIG. 5 shows these shapes for an adjusted phase angle between 90 degrees and 180 degrees.

Curve V1 is the shape of the supply voltage, curve V2 is the shape of the voltage across capacitor C2, curve V3 is the shape of the voltage between the first and second output terminals of the rectifier, and curve V4 is the shape of the voltage between output terminals in case the load were an incandescent lamp instead of a LED light source.

In FIG. 4 it can be seen that the gradient of curve V2 changes from positive to negative, when the dimmer switch S1 is made non-conductive. In FIG. 5 it can be seen that soon after the dimmer switch S1 has been made non-conductive, the deviation between curve V1 and curve V3 increases.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. Dimmable LED light source comprising:

a rectifier having rectifier input terminals for connection to respective output terminals of a phase cut dimmer of the trailing edge type and having rectifier output terminals, said phase cut dimmer having input terminals for connection to the mains supply, a first bleeder circuit connecting the rectifier output terminals, a series arrangement comprising a unidirectional element and a capacitor connecting the rectifier output terminals, a converter circuit, having input terminals coupled to respective sides of the capacitor and output terminals coupled to a LED load, for generating a current through the LED load, in dependence on a dim signal, out of a voltage present across the capacitor, a dim circuit for generating a dim signal as a function of the adjusted phase angle of the phase cut dimmer and for supplying the dim signal to a dim input of the converter circuit, the dim circuit comprising:

gradient detection circuitry for determining the gradient of the voltage across the capacitor and for determining as the adjusted phase angle the first value of the phase angle for which the gradient is negative, when the phase angle is smaller than or equal to 90 degrees during the first half period of the voltage between the rectifier output terminals, signal generating circuitry for generating a sinusoidal signal that represents the mains supply voltage, circuitry for activating the first bleeder when the phase angle is 90 degrees and for switching off the first bleeder when the adjusted phase angle is determined, deviation detection circuitry for detecting the deviation of the voltage across the rectifier output terminals from the sinusoidal signal, for comparing the deviation voltage with a reference voltage and for determining as the adjusted phase angle the first value of the phase angle for which the deviation voltage is higher than or equal to the reference voltage, when the phase angle is between 90 and 180 degrees during the second half period of the voltage across the rectifier output terminals.

2. Dimmable LED light source according to claim 1, wherein an input terminal of the signal generating circuitry is coupled to a first rectifier output terminal to synchronize the generated signal with the voltage between the output terminals of the rectifier.

3. Dimmable LED light source according to claim 1, wherein an input terminal of the signal generating circuitry is coupled to a first input terminal of the converter circuit for measuring the maximal amplitude of the voltage across the capacitor and for making the amplitude of the generated signal equal to the maximal amplitude.

4. Dimmable LED light source according to claim 1, wherein the dim circuit is equipped with circuitry for disabling the gradient detection circuitry and activating the deviation detection circuitry, when the phase angle is 90 degrees, and for activating the gradient detection circuitry and disabling the deviation detection circuitry, when the phase angle is 180 degrees.

5. Dimmable LED light source according to claim 1, comprising a second bleeder circuit connecting the rectifier output terminals, for charging a power supply in the phase cut dimmer and resetting a timer circuit comprised in the phase cut dimmer.

6. Dimmable LED light source according to claim 1, wherein the dim circuit includes a low pass filter.

7. Dimmable LED light source according to claim 1, comprising circuitry, equipped with a counter, for suppressing the determination of the adjusted phase angle during a predetermined fraction of the periods of the rectified phase cut supply voltage.

8. Method of dimming a LED light source, comprising the steps of providing a phase cut dimmer and using the phase cut dimmer to generate a phase cut sinusoidal supply voltage out of a sinusoidal supply voltage, rectifying the phase cut sinusoidal supply voltage using a rectifier having a first rectifier output terminal and a second rectifier output terminal, supplying the rectified phase cut sinusoidal supply voltage to a series arrangement of a unidirectional element and a capacitor, providing a converter circuit having a LED load coupled to its output terminals and using the converter for generating a current through said LED load out of a voltage across the capacitor, determining the gradient of the voltage across the capacitor, determining as the adjusted phase angle the first value of the phase angle for which the gradient is negative, when the phase angle is between 90 and 180 degrees during the first half period of the rectified sinusoidal supply voltage, generating a sinusoidal signal that represents the mains supply voltage, activating a bleeder when the phase angle is 90 degrees and switching off the bleeder after the adjusted phase angle is determined, detecting a deviation of the rectified phase cut sinusoidal supply voltage from the sinusoidal signal, when the phase angle is between 90 and 180 degrees during the second half period of the rectified sinusoidal supply voltage, comparing the deviation voltage with a reference voltage, determining as the adjusted phase angle the value of the phase angle for which the deviation voltage is higher than or equal to the reference voltage, generating the dim signal as a function of the adjusted phase angle, and controlling the magnitude of the current through the LED load as a function of the dim signal.

* * * * *